United States Patent [19]

Bierwirth

[11] Patent Number: 4,674,215

[45] Date of Patent: Jun. 23, 1987

[54] PROTECTIVE COVER BY LOADING FLAP IN A BREECH APERTURE

[75] Inventor: Adolf P. Bierwirth, Kaarst, Fed. Rep. of Germany

[73] Assignee: Rheinmetall GmbH, Duesseldorf, Fed. Rep. of Germany

[21] Appl. No.: 580,525

[22] Filed: Feb. 15, 1984

[30] Foreign Application Priority Data

Feb. 28, 1983 [DE] Fed. Rep. of Germany ..... 3306936

[51] Int. Cl.[4] ..... F41F 11/02

[52] U.S. Cl. ..... 42/23; 89/24; 89/45

[58] Field of Search ..... 89/24, 22, 4.2, 45, 89/46, 47; 42/23

[56] References Cited

U.S. PATENT DOCUMENTS 2,402,581 6/1946 Ruau ..... 89/24

3,276,322 10/1966 Christiansson ..... 89/45

4,133,126 1/1979 Lipp ..... 89/22 X

*Primary Examiner*—John F. Terapane

*Assistant Examiner*—John S. Maples

[57] ABSTRACT

An arrangement for bridging over the path traversed by cartridge being loaded via a loading tray and loading channel in a breech plate into the loading chamber of the weapon. The arrangement includes a trough-shaped flap which is pivotally mounted on the breech plate in such a way that it provides a guidance for the cartridge so that it cannot be damaged by a difference in height between the lower edge of the loading chamber and the breech block. The flap is pivoted about a horizontal axis when the breech block is in the open position and its free end remains at the level of the lower edge of the loading chamber until the cartridge casing has been securely guided into the loading chamber.

9 Claims, 2 Drawing Figures

PROTECTIVE COVER BY LOADING FLAP IN A BREECH APERTURE

BACKGROUND OF THE INVENTION

It is known to provide a protective cover in the breech block. Such protective cover generally extends, with open breech block, from the breech plate over the breech block to form a bridge, having a flexible bottom blade (see for example co-assigned U.S. Pat. No. 4,133,126). By means of such a guide blade the loading, respectively the ejection of cartridges or cartridge casings, can be achieved without malfunctioning. For example, during loading the cartridge stump will not impact against the edge of the breech block which confronts the breech plate; respectively during ejection of the cartridge stump, the latter does not impact against the confronting misaligned breech plate.

This known construction frequently malfunctions and is subject to wear because of the continuous entrainment of the deflecting blade with the breech block. Moreover, with this known blade the region between the loading chamber and the loading blade is not covered so that such an arrangement is not usable for long ammunition in which the cartridge is joined to the casing via a shaft.

SUMMARY OF THE INVENTION

It is therefore an object of this invention to provide a secure and non-malfunctioning arrangement by means of which the breech guide path in the region of the loading chute is bridged over in such a way that during loading a damaging misalignment between the loading chamber lower edge and loading chute cannot disturb the smooth operation of the loading process and that also during loading and ejection a misalignment between the breech block and the breech plate is also bridged over.

BRIEF DESCRIPTION OF THE DRAWING

Other advantages of the invention will become apparent from the following detailed description and drawing, in which.

DETAILED DESCRIPTION

Figure 1:
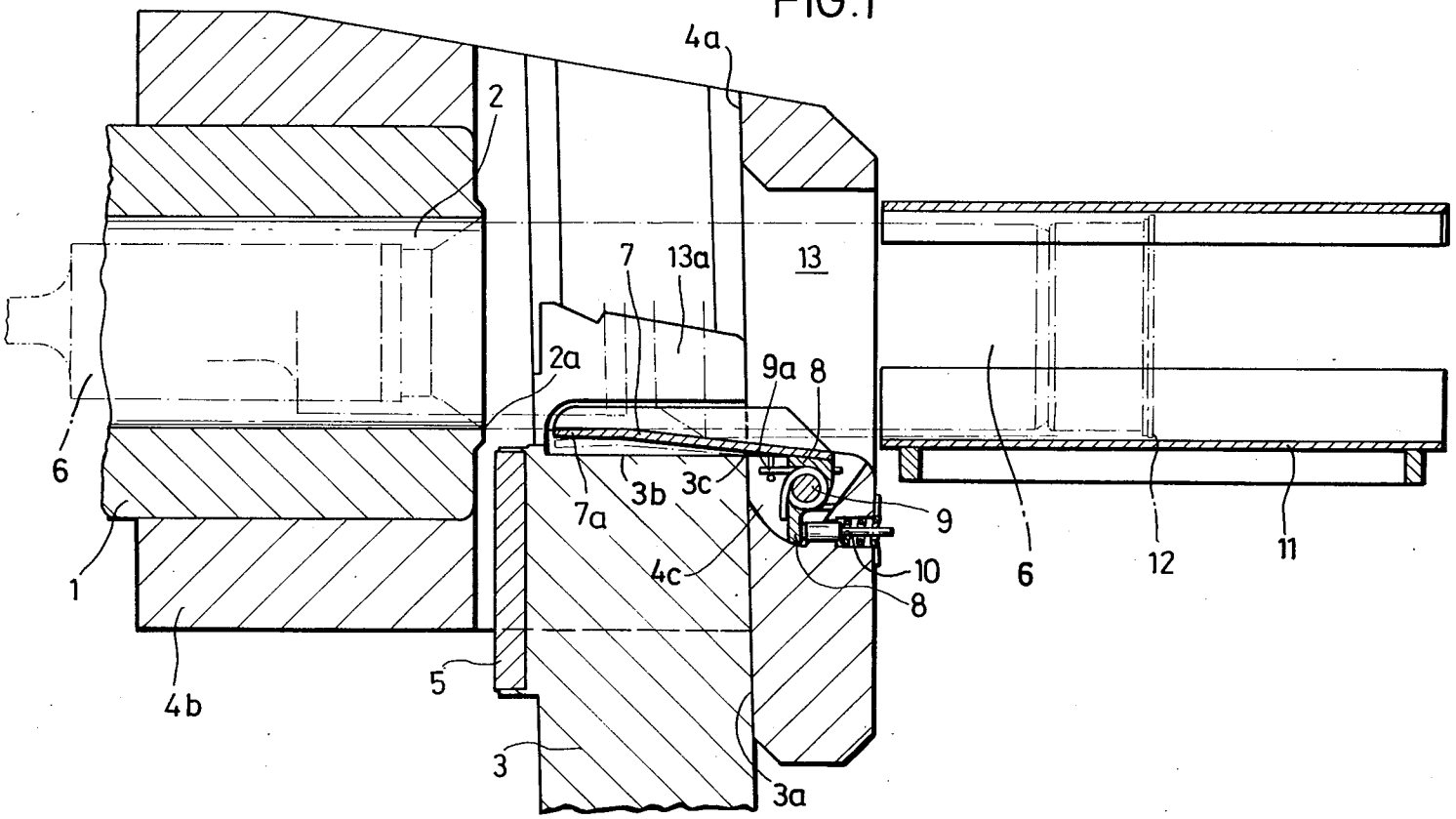
FIG. 1 is a cross-sectional longitudinal view illustrating the arrangement of the invention in the loading position with an aligned loading cylinder.

There is illustrated in FIG. 1 a gun barrel 1 which includes a loading chamber 2 having a lower rear edge 2*a*. The weapon includes the usual breech block 3 which is mounted as illustrated in the breech housing 4. (The terms "breech plate" and "breech housing" on the one hand and "loading passage" and "loading channel" on the other hand are used interchangeably). A pressure plate 5 is mounted on the front face of the block 3 which, when the breech is closed, sealingly closes the loading chamber 2. The breech block 3 has an upper rear corner 3*c*. This sealing movement is achieved by means of natural sliding contact of the screwed face of the breech block 3 moving along the forward scewed face 3*a* of the breech plate 4*b* which has a front wall 4*a*. A cartridge-projectile 6 extends from its nose rearwarly to its cartridge bottom 12. The flap 7 is pivotally mounted by means of a projecting leg 8 via a pivot shaft 9 (which may be a torsion spring rod) in an indentation 4*c* of the breech plate 4*b*. The torsion rod spring can be a conventional torsion spring 9*a* which urges the flap 7 into the position shown in dash-dot line of FIG. 1 in which the flap is positioned in the bottom 3*b* of the trough 13*a*. This flap 7 has at its forward end a cam region 7*a* which aligns with the lower rear edge 2*a* of the loading chamber 2. A spring biased stop pin 10 is adjustably mounted in a mating bore of the breech plate 4*b* and serves to limit the pivotal movement of the flap 7 about the pivot pin 9 as will be described hereinbelow. The loading pipe 11 forms jointly with the trough 13*a* in the breech block 3 and the flap 7 a loading passage which is formed during loading.

Figure 2:
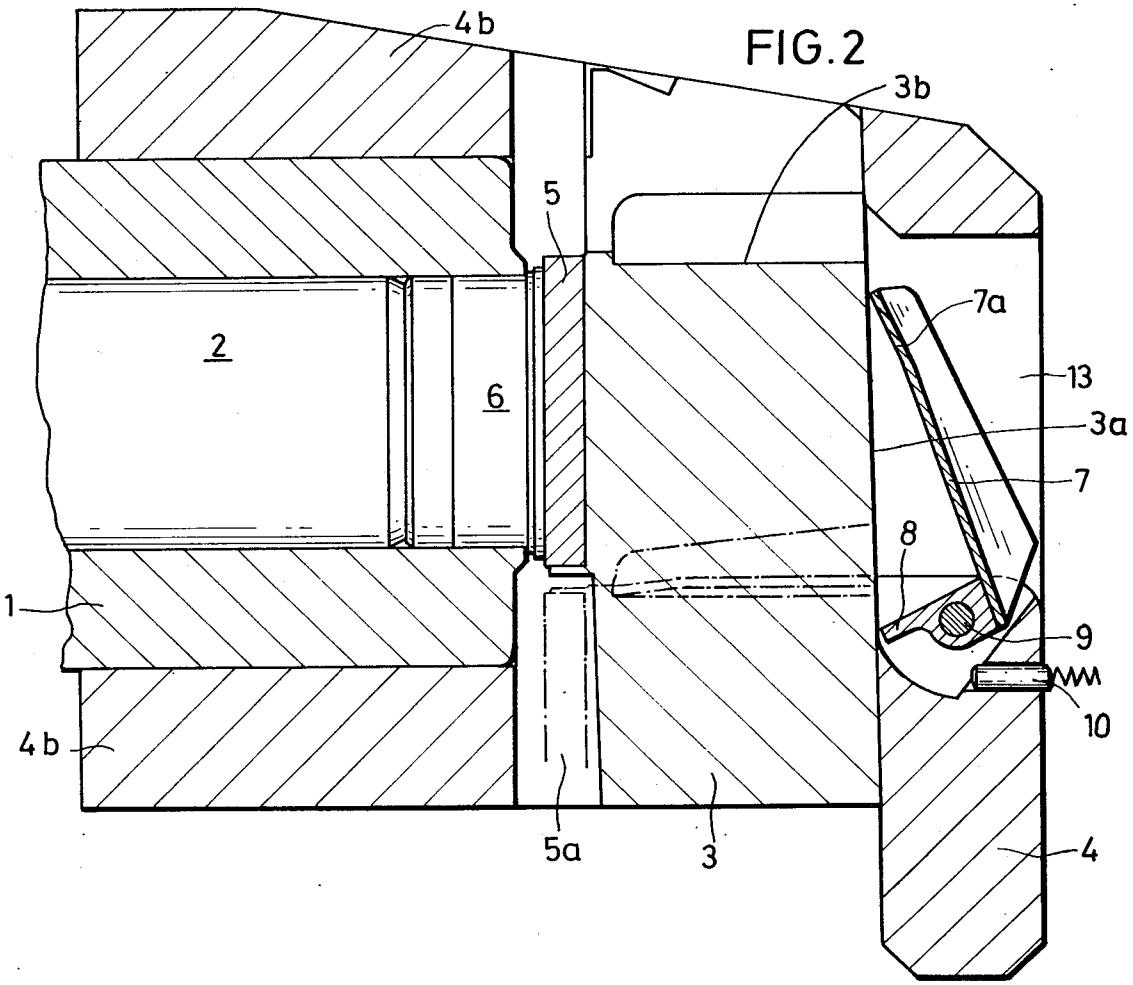
FIG. 2 is a cross-sectional view of the arrangement of the invention in the loading position in which the upwardly swinging cover plate, which is mounted on the breech plate is shown in two positions.

The arrangement of the invention operates as follows: As is illustrated in FIG. 1 the rear portion of the cartridge-projectile just reaches during the sliding-in the lower edge 2*a* of the loading chamber 2. Since the rear portion of the cartridge-projectile 6 rests on the cam portion 7*a* of the flap 7, which cam portion 7*a* is in alignment with the lower rear edge 2*a* of the loading chamber, this rear portion of the cartridge-projectile 6 cannot impinge on the lower rear edge 2*a*. Moreover, the upper wall 3*b* which forms part of the bottom of the trough 13*a* of the breech block 3 is almost fully covered by the flap 7, so that also no impingement on this lower edge of the breech block 3 can occur. As soon as the cartridge bottom 12, during the further forward sliding in the region of the cam portion 7*a* of the protective tongue (flap) 7, reaches the flap 7, the stop pin 10 self-adjusts in such a way that it yields so that the flap 7 can move into the position shown in dot-dash lines in FIG. 1, in which position the forward cam portion 7*a* swings somewhat downwardly and permits the traverse or passing over of the cartridge bottom 12. During the following closing of the breech block 3 it causes an upward pivoting of the flap 7 by means of its rear wall 3*a*, as illustrated in FIG. 2, into the loading passage region of the breech housing 4*b*.

The arrangement of the invention achieves that during automatic loading of a weapon having a dropping breech block no damage to the cartridge cover or cartridge casing can occur and no hinderance during cartridge ejection occurs since the flap 7 is continuously pressed by a spring force against the upper wall 3*b* of the breech block 3.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. A device for facilitating the insertion of cartridges in a weapon having a loading chamber, a sliding breech block movable between an open and closed position and a breech plate, comprising in combination, a trough-shaped flap pivotally mounted on the breech housing about a horizontal axis and pivoting via the action of torsion spring means into alignment with the loading chamber when the breech block is in the open position so that its free end remains at the level of the lower edge of the loading chamber until the cartridge bottom has moved past said horizontal axis towards said loading chamber, and including a trough member mounted on the breech block, said flap being pivoted via the action of said torsion spring means into said trough member when said breech block is in the open position and biasing means operatively connected to said flap to limit the pivoting movement thereof.

2. A device for facilitating the insertion of cartridges in a weapon as set forth in claim 1, wherein said torsion spring means includes a torsion spring rod on which said flap is pivotally mounted.

3. A device for facilitating the insertion of cartridges in a weapon as set forth in claim 2, including a spring biased rod slidably mounted in said breech plate and having a free end in abutting contact with said flap so as to resiliently limit its pivotal movement past a predetermined plane.

4. A device for facilitating the insertion of cartridges in a weapon as set forth in claim 2, wherein the spring biased rod is adjustable in the breech plate so that it permits a further pivotal movement past the plane in which the lower edge of the loading chamber is disposed as soon as the cartridge bottom, which is of larger diameter than the remainder of the cartridge, has reached that region of the flap which is at the level of the lower edge of the loading chamber.

5. A device for facilitating the insertion of cartridges in a weapon as set forth in claim 4, wherein said flap includes a main cartridge supporting portion and a leg portion essentially perpendicularly extending therefrom, said breech plate having a recess and said leg portion pivotally moving within the confines of said recess, the free end of said spring biased rod extending into said recess.

6. A device for facilitating the insertion of cartridges in a weapon as set forth in claim 5, wherein said breech block pivots said flap upwardly into a loading channel formed by the breech plate when moving into its closed position and said torsion spring rod urging the free end of the flap against the breech block.

7. A device for facilitating the insertion of cartridges in a weapon as set forth in claim 6, wherein the lower edge of the loading channel formed by the breech plate and the end of the flap remote from the loading chamber are disposed in a plane which is situated below the lower edge of the loading chamber when the breech block is in the open position.

8. A device for facilitating the insertion of cartridges in a weapon as set forth in claim 7, wherein said flap is curved so as to form a trough.

9. A device for facilitating the insertion of cartridges in a weapon as set forth in claim 8, including a loading pipe operatively mounted in said weapon and forming a loading channel having substantially the same diameter as said loading chamber, said cartridge being slidably displaceable from the tray via the flap, trough member and the breech plate into the loading chamber.

* * * * *